US005877367A

United States Patent [19]

Witte

[11] Patent Number: 5,877,367

[45] Date of Patent: Mar. 2, 1999

[54] DEHYDROCYCLIZATION PROCESS WITH DOWNSTREAM DIMETHYLBUTANE REMOVAL

[75] Inventor: David H. Witte, Humble, Tex.

[73] Assignee: Chevron Chemical Company, San Ramon, Calif.

[21] Appl. No.: 767,910

[22] Filed: Dec. 17, 1996

[51] Int. Cl.[6] ..... C07C 15/00; C07C 2/52; C10G 35/00; C10G 35/04

[52] U.S. Cl. ..... 585/413; 585/407; 585/412; 585/419; 208/133; 208/138; 208/137; 208/141

[58] Field of Search ..... 585/407, 412, 585/413, 419; 208/133, 138, 137, 141

[56] References Cited

U.S. PATENT DOCUMENTS 4,650,565 3/1987 Jacobson et al. ..... 208/138
4,897,177 1/1990 Nadler ..... 208/79

*Primary Examiner*—Glenn Caldarola
*Assistant Examiner*—Thuan D. Dang
*Attorney, Agent, or Firm*—Thomas G. DeJonghe

[57] ABSTRACT

In the present invention, dimethylbutanes are removed from the raffinate component of the feed to a dehydrocyclization process. Thus, according to a preferred embodiment, a process is provided for producing aromatics by the following steps:

(a) contacting fresh paraffins rich feed hydrocarbons, containing 0.1 to 20.0 wt. % dimethylbutanes with a highly selective dehydrocyclization catalyst in a reaction zone, under dehydrocyclization reaction conditions, to convert paraffins to aromatics and obtain an aromatics rich effluent;

(b) separating aromatics from the effluent to obtain an aromatics lean raffinate;

(c) removing dimethyl butanes from the raffinate to obtain a raffinate of reduced dimethylbutane content; and (d) recycling the raffinate of reduced dimethylbutane content to the reaction zone.

Preferably, the dehydrocyclization catalyst used is a nonacidic, monofunctional catalyst. Platinum on L zeolite is a particularly preferred highly selective dehydrocyclization catalyst for use in the process.

10 Claims, 1 Drawing Sheet

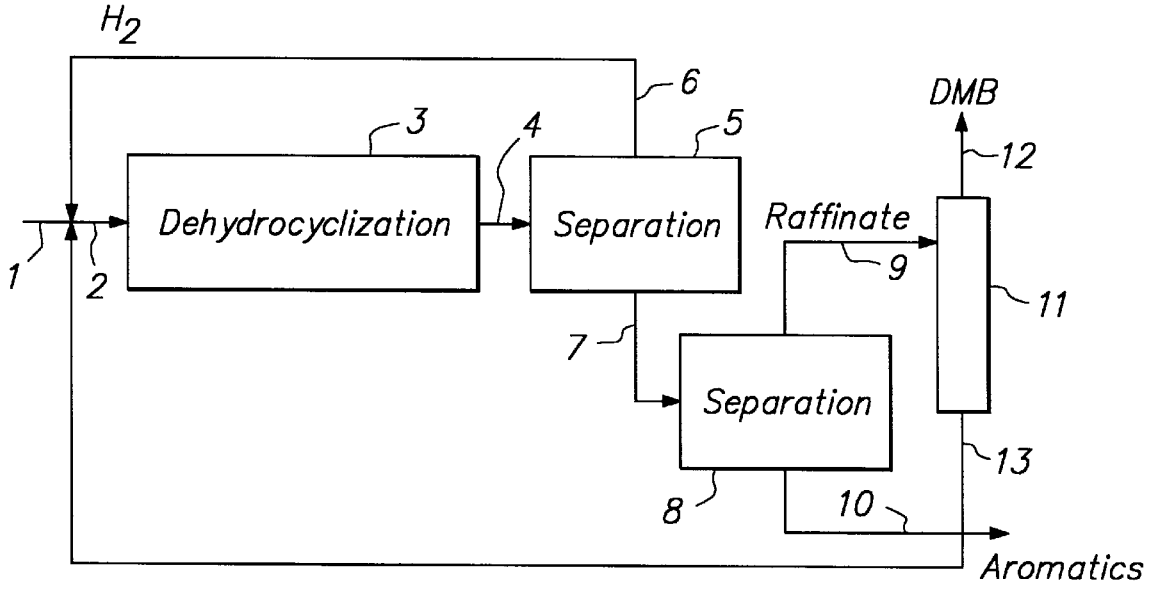
H2
6
DMB
3
4
5
12
Dehydrocyclization
Separation
Raffinate
1
2
9
11
7
Separation
13
8
10
Aromatics

DEHYDROCYCLIZATION PROCESS WITH DOWNSTREAM DIMETHYLBUTANE REMOVAL

FIELD OF THE INVENTION

The present invention is directed to dehydrocyclization using a highly selective dehydrocyclization catalyst, and particularly to dimethylbutane removal from the recycle to a highly selective dehydrocyclization catalytic zone.

BACKGROUND OF THE INVENTION

In the process of the present invention aromatics are formed from feed hydrocarbons by dehydrocyclization. Other reactions may take place in the reaction zone, and the reaction step may more generally be referred to as reforming. Thus, in the reaction step of the process of the present invention, besides the dehydrocyclization or aromatization reaction, other reactions can occur, such as dehydrogenation, isomerization, hydroisomerization, cyclization and hydrocracking. The main reaction is dehydrocyclization to form aromatics from paraffins.

U.S. Pat. No. 4,104,320, which was granted Aug. 1, 1978, discloses that it is possible to dehydrocyclize paraffins to produce aromatics with high selectivity using a monofunctional nonacidic catalyst. Preferably, the catalyst comprises a type L zeolite. The type L zeolite preferred in the U.S. Pat. No. 4,104,320 process are those having exchangeable cations of which at least 90% are sodium, lithium, potassium, rubidium or cesium. The catalyst used in U.S. Pat. No. 4,104,320 also contains at least one Group VIII noble metal (or tin or germanium). In particular, catalysts having platinum in an L zeolite, wherein potassium in the L zeolite has been exchanged to replace a portion of the potassium with rubidium or cesium, are claimed in the '320 patent to achieve exceptionally high selectivity for n-hexane conversion to benzene. As disclosed in U.S. Pat. No. 4,104,320, the L zeolite used is typically synthesized in the potassium form. A portion, usually not more than 80%, of the potassium cations can be exchanged so that other cations, preferably rubidium or cesium, replace the exchangeable potassium.

After U.S. Pat. No. 4,104,320 in 1978, an important step forward was disclosed in U.S. Pat. Nos. 4,434,311; 4,435,283; 4,447,316; and 4,517,306, all of which patents were granted in 1984 and 1985. These patents describe dehydrocyclization catalysts comprising a large-pore zeolite exchanged with an alkaline earth metal (barium, strontium or calcium, preferably barium) and wherein the catalyst contains one or more Group VIII metals, most preferably platinum. An essential element in the catalyst of these patents is the alkaline earth metal. Especially when the alkaline earth metal is barium, and the large-pore zeolite is L zeolite, the catalysts of these patents were found to provide higher selectivities than the corresponding alkali exchanged L zeolite catalyst disclosed in U.S. Pat. No. 4,104,320.

These platinum on L zeolite catalysts referred to in the previous two paragraphs, whether in the potassium form, or other alkali metal form, or in the alkaline earth metal exchanged form, are substantially "nonacidic". These nonacidic catalysts have been referred to as "monofunctional" catalysts. Such nonacidic, monofunctional catalysts are highly selective for forming aromatics via dehydrocyclization of paraffins.

Having a highly selective catalyst, commercialization seemed straightforward. However, that was not the case. It was found that the high selectivity L zeolite catalysts containing a Group VIII metal were unexpectedly susceptible to sulfur poisoning at ultra low levels of sulfur in the feed. U.S. Pat. No. 4,456,527 discloses this discovery. Specifically, it was found that the concentration of sulfur in the hydrocarbon feed must be reduced to ultra low levels, preferably less than 50 parts per billion, to achieve acceptable stability, i.e., long run length, for the catalyst when used in the dehydrocyclization process.

With the progress of U.S. Pat. No. 4,456,527, more attention was given to the process arrangement under which the overall dehydrocyclization process to produce aromatics was carried out.

U.S. Pat. Nos. 4,648,961 and 4,650,565 disclose processes using a highly selective dehydrocyclization catalyst wherein a paraffins rich feed is contacted with the catalyst to form aromatics, then the aromatics are separated from the reaction zone effluent by means of a solvent extraction step, or via molecular sieve separation, and a raffinate paraffins rich stream from the solvent extraction or molecular sieve separation step is recycled to the dehydrocyclization reaction zone.

U.S. Pat. No. 4,594,145 and Reissue Pat. No. 33,323 disclose a process using a highly selective dehydrocyclization catalyst wherein a paraffins rich feed is contacted with the catalyst to form aromatics, then aromatics are separated from the reaction zone effluent, and the remaining paraffins are recycled to the reaction zone.

U.S. Pat. Nos. 4,568,656 and 4,595,668 disclose use of highly selective dehydrocyclization catalyst wherein the Group VIII metal component of the catalyst is highly dispersed on a zeolite L support. These two U.S. patents state (see Col. 16, line 38, of the '668 patent): "Since the catalyst is monofunctional and does not promote isomerization without cyclization, feed compounds such as dimethylbutanes are not effective."

Another process oriented patent using a highly selective dehydrocyclization catalyst is European Patent 335,540. This patent discloses a process wherein a hydrocarbon feed is (a) separated into a first fraction comprising $C_5$ minus hydrocarbons and dimethylbutanes, and a second fraction comprising $C_6$ plus hydrocarbons; (b) separating the second fraction into (i) a light fraction comprising not more than 10% by volume dimethylbutanes, the light fraction being selected from a $C_6$ fraction, a $C_7$, a $C_8$ fraction, a $C_6$–$C_7$ fraction, $C_7$–$C_8$ fraction, $C_6$–$C_8$ and a fraction consisting essentially of $C_6$ and $C_8$ hydrocarbon; and (ii) a heavy fraction; and (c) dehydrocyclizing the light fraction under dehydrocyclization conditions in the presence of a monofunctional catalyst. Thus, according the EP 335,540 process, dimethylbutanes are removed from the hydrocarbon fresh feed prior to dehydrocyclization of the fresh feed to form aromatics.

SUMMARY OF THE INVENTION

According to the present invention, a process is provided for dehydrocyclization, which process comprises:

(a) contacting fresh paraffins rich feed hydrocarbon containing 0.1 to 20 wt. % dimethylbutanes with a highly selective dehydrocyclization catalyst in a reaction zone under dehydrocyclization reaction conditions to convert paraffins to aromatics and obtain an aromatics rich effluent;

(b) separating aromatics from the effluent to obtain a paraffins rich raffinate;

(c) removing dimethylbutanes from the raffinate to obtain a raffinate of reduced dimethylbutane content; and (d) recycling the raffinate of reduced dimethylbutane content to the reaction zone.

Preferably, the highly selective dehydrocyclization catalyst is a nonacidic catalyst.

The catalyst preferably includes a Group VIII metal, most preferably platinum, and preferably includes a unidimensional crystalline aluminosilicate. The term "unidimensional" means that the pores or channels in the crystals run substantially only in one direction along the length or c-axis of the crystals.

Preferred aluminosilicates are zeolite L, zeolite omega, ZSM-10 and mordenite.

Most preferably, the aluminosilicate is zeolite L. Zeolite L is unidimensional.

In the process of the present invention, a centrally important feature is the separation of a major portion of dimethylbutanes downstream of the dehydrocyclization reaction zone. Thus, the dimethylbutanes are not separated primarily from the fresh feed to the process. Rather, in the present invention, the dimethylbutanes are separated primarily from the effluent from the dehydrocyclization reaction. The downstream dimethylbutane removal may be carried out after aromatics are separated from the reaction zone effluent, or prior to aromatics separation; but, in either case, downstream of the dehydrocyclization reaction zone.

The aromatics separation from the reaction step effluent preferably is done by solvent extraction, distillation or molecular sieve extraction. Most preferably, the aromatics separation is done by solvent extraction. This aromatics separation step results in an aromatics rich product stream, and a paraffins rich raffinate stream.

In the process of the present invention, dimethylbutanes preferably are separated from the raffinate stream. Then the raffinate is recycled to the reaction step.

Among other factors, the present invention is based on my conception of removing the dimethylbutanes primarily downstream of the dehydrocyclization reaction step rather than removing dimethylbutanes from the fresh feed to the reaction zone. Further, the present invention is based on my finding that this unusual point of dimethylbutanes removal results in surprising advantages in terms of yield and operating expense for the highly selective dehydrocyclization process.

According to one embodiment of the present invention, as described above, downstream dimethylbutane removal is carried out after aromatics are removed from the effluent from the dehydrocyclization step.

According to another embodiment of the present invention, dimethylbutanes are removed downstream of the dehydrocyclization reaction zone but prior to treatment of the reaction zone effluent to separate aromatics from paraffins. Thus, according to this embodiment, a process is provided for dehydrocyclization of hydrocarbon which comprises:

(a) contacting fresh paraffins rich feed hydrocarbon containing 0.1 to 20.0 wt. % dimethylbutanes with a highly selective dehydrocyclization catalyst in a reaction zone under dehydrocyclization reaction conditions to convert paraffins to aromatics and obtain an aromatics rich effluent;

(b) removing dimethylbutanes from the aromatics rich effluent to obtain a paraffins-aromatics mixture of reduced dimethylbutane content;

(c) separating aromatics from the paraffins-aromatics mixture to obtain an aromatics lean raffinate; and (d) recycling the raffinate to the reaction zone.

BRIEF DESCRIPTION OF THE DRAWING

The drawing is a simplified schematic process flow diagram illustrating a preferred embodiment of the present invention, wherein dimethylbutanes are removed downstream from the dehydrocyclization reaction zone.

DETAILED DESCRIPTION OF THE INVENTION

Referring to the simplified drawing in more detail, fresh feed is introduced to the dehydrocyclization reaction zone via lines 1 and 2. Suitable feeds are nonaromatic organic compounds, preferably naphtha boiling range feedstocks such as $C_6$–$C_{10}$, more preferably $C_6$–$C_8$, paraffins. Because dehydrocyclization is the key reaction in reaction zone 3, the feedstock preferably is $C_6$ or higher nonaromatic organic compounds. Examples of preferred $C_6$–$C_8$ paraffinic feedstock components include n-hexane, n-heptane and n-octane The naphtha feedstock may be derived directly from crude petroleum by distillation, or may be indirectly derived from a petroleum feedstock by separation of a naphtha boiling range stream from the effluent from hydrocracking, coking or catalytic cracking. Suitable naphtha feedstocks may boil between about 60° C. and 220° C. Preferably, the naphtha feedstock is predominantly (more than one half by weight) paraffins, and most preferably is $C_6$–$C_8$ paraffins. $C_6$ paraffins, especially n-hexane and also methylpentanes, are particularly preferred feedstocks.

As discussed in more detail below, these feedstocks almost invariably contain dimethylbutanes, as the dimethylbutanes boil close to hexanes. Table 1 below lists the boiling points of hydrocarbons in the $C_5$–$C_7$ paraffin range.

TABLE 1

Boiling Points of Selected $C_5$–$C_7$ Hydrocarbons

| | °F. | °C. | |
|---|---|---|---|
| 2-Methylbutane (isopentane) | 82 | 28 | |
| n-Pentane | 97 | 36 | $C_5H_{12}$ |
| Cyclopentane | 120 | 49 | $C_5H_{10}$ |
| 2,2-Dimethylbutane | 121.5 | 50 | |
| 2,3-Dimethylbutane | 136 | 58 | |
| 2-Methylpentane | 140.5 | 60 | $C_6H_{14}$ |
| 3-Methylpentane | 145.9 | 63 | |
| n-Hexane | 156 | 69 | |
| Methylcyclopentane | 161 | 72 | $C_6H_{12}$ |
| Cyclohexane | 177 | 81 | $C_6H_{12}$ |
| 2,2,3-Trimethylbutane | 178 | 81 | |
| 2,2-Dimethylpentane | 174.5 | 79 | |
| 2,3-Dimethylpentane | 194 | 90 | |
| 2,4-Dimethylpentane | 177 | 80 | |
| 3,3-Dimethylpentane | 187 | 86 | $C_7H_{16}$ |
| 2-Methylhexane | 194 | 90 | |
| 3-Methylhexane | 197 | 92 | |
| 3-Ethylpentane | 200 | 93 | |
| n-Heptane | 209 | 98 | |

As can be seen from Table 1, dimethylbutanes boil near n-hexane, and also near methylpentanes, both of which are preferred feedstocks for the dehydrocyclization reaction zone.

The net fresh feed to the process of the present invention will contain dimethylbutanes, typically from 0.1 to 20 wt. % dimethylbutanes, preferably 0.3 to 18%, more preferably 0.5 to 18%, and most preferably 1.0 to 15%, based on weight of the net or fresh hydrocarbon feed to the process.

As dimethylbutanes are not desired in the dehydrocyclization reaction zone 3, the prior art teaches removal of dimethylbutanes from the fresh feed. The separation of dimethylbutanes from the fresh feed can be done by distillation, as taught by the previously cited EP 335,540.

However, in the process of the present invention, dimethylbutanes are not primarily removed from the fresh feed to reaction zone 3. In the present invention, dimethylbutanes are primarily removed downstream in the process, after aromatics have been formed in the dehydrocyclization reaction zone. This downstream removal of dimethylbutanes is further described below.

The term "fresh feed" is used herein to mean the net hydrocarbon feed to the process which has not been passed through the dehydrocyclization zone.

In the present invention, reaction zone 3 uses a dehydrocyclization catalyst which has a high selectivity to form aromatics. The term "selectivity" as used in the present invention is defined as a percentage of moles of acyclic hydrocarbons converted to aromatics compared to moles converted to aromatics and cracked products. Thus, percent selectivity may be defined by the following formula:

$$\text{i.e., Selectivity} = \frac{100 \times \text{moles of acyclic hydrocarbons converted to aromatics}}{\text{moles of acyclic hydrocarbons converted to aromatics and cracked products}}$$

Isomerization of paraffins and interconversion paraffins and alkylcyclopentanes having the same number of carbon atoms per molecule are not considered in determining selectivity.

The selectivity for converting acyclic hydrocarbons to aromatics is a measure of the effectiveness of the dehydrocyclization reaction step in converting acyclic hydrocarbons to the desired and valuable products: aromatics and hydrogen, as opposed to the less desirable by-products, such as products from hydrocracking in the dehydrocyclization reaction zone.

Highly selective catalysts produce more hydrogen than less selective catalysts because hydrogen is produced when acyclic hydrocarbons are converted to aromatics, whereas hydrogen is consumed when acyclic hydrocarbons are converted to cracked products. Increasing the selectivity of the process increases the amount of hydrogen produced (more aromatization) and decreases the amount of hydrogen consumed (less cracking).

Preferred catalysts for use in reaction zone 3 are highly selective dehydrocyclization catalysts, particularly catalysts comprising a Group VIII metal dispersed on a unidimensional crystalline aluminosilicate. The highly selective dehydrocyclization catalyst preferably is a nonacidic catalyst, and preferably is a monofunctional catalyst.

Preferably, the catalyst used in reaction zone 3 contains one or more Group VIII metals, for example, nickel, iridium, rhodium, palladium, rhenium or platinum. The most preferred Group VIII metals for use in the dehydrocyclization catalyst are iridium, palladium and platinum, most especially, platinum. The amount of Group VIII metal in the catalyst preferably is between 0.1 and 5 wt. % based on the total catalyst, more preferably 0.3 to 2 wt. %.

The Group VIII metal or metals may be introduced to the catalyst such as the zeolite component of the catalyst, by synthesis, impregnation, or ion exchange carried out in aqueous solution of an appropriate salt. When it is desired to introduce two Group VIII metals into the zeolite component of the catalyst, the operation may be carried out simultaneously or sequentially.

By of way of example, platinum can be introduced by impregnating the zeolite with an aqueous solution of tetrammine (II) nitrate, chloroplatinic acid, chloroplatinous acid, diamino-platinum or tetrammineplatinum (II) chlorite. In an ion exchange process, platinum can be introduced by using cationic platinum complexes such as tetrammineplatinum (II) nitrate.

Preferably, an inorganic oxide is used as a carrier to bind the zeolite containing the Group VIII metal and provide added strength and integrity for the catalyst as a particle. The carrier can be a natural or synthetically produced inorganic oxide or a combination of inorganic oxides. Typical inorganic oxides supports which can be used include clays, alumina and silica in which acidic sites are preferably exchanged by cations which do no impart strong acidity (such as sodium, potassium, rubidium, cesium, calcium, strontium or barium).

Preferred unidimensional aluminosilicates for use in the dehydrocyclization catalyst are L zeolite, omega zeolite, ZSM-10, cancrinite and mordenite. L zeolite is especially preferred for the catalyst used in reaction zone 3.

Type L zeolites are synthetic zeolites. A theoretical formula is $M_9/n[A1O_2)_9(SiO_2)_{27}]$ in which M is a cation having the valency n.

The real formula may vary without changing the crystalline structure; for example, the mole ratio of 65 silicon to aluminum (Si/A1) may vary from 1.0 to 3.5.

Although there are a number of cations that may be present in zeolite L, in one embodiment, it is preferred to synthesize the potassium form of the zeolite, i.e., the form in which the exchangeable cations present are substantially all potassium ions. The reactants accordingly employed are readily available and generally water soluble. The exchangeable cations present in the zeolite may then conveniently be replaced by other exchangeable cations, as will be shown below, thereby yielding isomorphic form of zeolite L.

In one method of making zeolite L, the potassium form of zeolite L is prepared by suitably heating an aqueous metal aluminosilicate mixture whose composition, expressed in terms of the mole ratios of oxides, falls within the range:

| | |
|---|---|
| $K_2O/(K_2O + Na_2O)$ | From about 0.33 to about 1 |
| $(K_2O + Na_2O)/SiO_2$ | From about 0.35 to about 0 5 |
| $SiO_2/A1_2O3$ | From about 10 to about 28 |
| $H_2O/(K_2O + Na_2O)$ | From about 15 to about 41 |

The desired product is hereby crystallized out relatively free from zeolite of dissimilar crystal structure.

The potassium form of zeolite L may also be prepared in another method along with other zeolite compounds by employing a reaction mixture whose composition, expressed in terms of mole ratios of oxides, falls within the following range:

| | |
|---|---|
| $K_2O/(K_2O + Na_2O)$ | From about 0.26 to about 1 |
| $(K_2O + Na_2O)/SiO_2$ | From about 0.34 to about 0 5 |
| $SiO_2/A1_2O3$ | From about 15 to about 28 |
| $H_2O/(K_2O + Na_2O)$ | From about 15 to about 51 |

It is to be noted that the presence of sodium in the reaction mixture is not critical to the present invention.

When the zeolite is prepared from reaction mixtures containing sodium, sodium ions are generally also included within the product as part of the exchangeable cations together with the potassium ions. The product obtained from the above ranges has a composition, expressed in terms of moles of oxides, corresponding to the formula:

$$0.9\text{–}1.3[(1-x)K_2O,xNa_2O]:A1_2O_3:5.2\text{–}6.9SiO_2:H_2O$$

wherein "x" may be any value from 0 to about 0.75 and "y" may be any value from 0 to about 9.

In making zeolite L, representative reactants are activated alumina, gamma alumina, alumina trihydrate and sodium aluminate as a source of alumina. Silica may be obtained from sodium or potassium silicate, silica gels, silicic acid, aqueous colloidal silica sols and reactive amorphous solid silicas. The preparation of typical silica sols which are suitable for use in the process of the present invention are described in U.S. Pat. No. 2,574,902 and U.S. Pat. No. 2,597,872. Typical of the group of reactive amorphous solid silicas, preferably having an ultimate size of less than 1 micron, are such materials as fume silicas, chemically precipitated and precipitated silica sols. Potassium and sodium hydroxide may supply the metal cation and assist in controlling pH.

In making zeolite L, the usual method comprises dissolving potassium or sodium aluminate and alkali, viz., potassium or sodium hydroxide, in water. This solution is admixed with a water solution of sodium silicate, or preferably with a water-silicate mixture derived at least in part from an aqueous colloidal silica sol. The resultant reaction mixture is placed in a container made, for example, of metal or glass. The container should be closed to prevent loss of water. The reaction mixture is then stirred to ensure homogeneity.

The zeolite may be satisfactorily prepared at temperatures of from about 90° C. to 200° C., the pressure being atmospheric or at least that corresponding to the vapor pressure of water in equilibrium with the mixture of reactants at the higher temperature. Any suitable heating apparatus, e.g., an oven, sand bath, oil bath or jacketed autoclave, may be used. Heating is continued until the desired crystalline zeolite product is formed. The zeolite crystals are then filtered off and washed to separate them from the reactant mother liquor. The zeolite crystals should be washed, preferably with distilled water, until the effluent wash water, in equilibrium with the product, has a pH of between about 9 and 12. As the zeolite crystals are washed, the exchangeable cation of the zeolite may be partially removed and is believed to be replaced by hydrogen cations. If the washing is discontinued when the pH of the effluent wash water is between about 10 and 11, the $(K_2O+Na_2O))/Al_2O_3$ molar ratio of the crystalline product will be approximately 1.0. Thereafter, the zeolite crystals may be dried, conveniently in a vented oven.

Zeolite L has been characterized in "Zeolite Molecular Sieves" by Donald W. Breck, John Wiley & Sons, 1974, as having a framework comprising 18 tetrahedra unit cancrinite-type cages linked by double 6-rings in columns and crosslinked by single oxygen bridges to form planar 12-membered rings. These 12-membered rings produce wide channels parallel to the c-axis with no stacking faults. Unlike erionite and cancrinite, the cancrinite cages are symmetrically placed across the double 6-ring units. There are four types of cation locations: A in the double 6-rings, B in the cancrinite-type cages, C between the cancrinite-type cages, and D on the channel wall. The cations in site D appear to be the only exchangeable cations at room temperature. During dehydration, cations in site D probably withdraw from the channel walls to a fifth site, site E, which is located between the A sites. The hydrocarbon sorption pores are approximately 7 to 8 Angstroms in diameter.

A more complete description of these zeolites is given, e.g., in U.S. Pat. No. 3,216,789 which, more particularly, gives a conventional description of these zeolites. U.S. Pat. No. 3,216,789 is hereby incorporated by reference to show a type L zeolite useful in the present invention.

Zeolite L differs from other large pore zeolites in a variety of ways, besides X-ray diffraction pattern.

One of the most pronounced differences is in the channel system of zeolite L. Zeolite L has a one-dimensional channel system parallel to the c-axis, while most other zeolites have either two-dimensional or three-dimensional channel systems. Zeolites A, X and Y all have three-dimensional channel systems. Mordenite (Large Pore) has a major channel system parallel to the c-axis, and another very restricted channel system parallel to the b-axis. Omega zeolite (Mazzite) has a one-dimensional channel system.

Another pronounced difference is in the framework of the various zeolites. Zeolite L has cancrinite-type cages linked by double-six rings in columns and crosslinked by oxygen bridges to form planar 12-rings. Zeolite A has a cubic array of truncated octahedra, beta-cages linked by double-four ring units. Zeolites X and Y both have truncated octahedra, beta-cages linked tetrahedrally through double-six rings in an arrangement like carbon atoms in a diamond.

Mordenite has complex chains of five-rings crosslinked by four-ring chains.

Omega has a fourteen-hedron of gmelinite-type linked by oxygen bridges in columns parallel to the c-axis.

ZSM-10 is constructed from columns of alternating cancrinite-type cages and double-six rings. In ZSM-10, there are two one-dimensional 12-ring pore systems which run parallel to the c-axis. One 12-ring channel is apparently identical to the undulating channel in the zeolite L framework, the other is apparently identical to the 12-ring channel in the framework of offretite. Thus, ZSM-10 is believed to have two distinct, parallel, 12-ring channel systems.

ZSM-10 is described in "ZSM-10: Synthesis and Tetrahedral Framework Structure", *Zeolites*, 16, 4, 236–244 (April 1996). The synthesis of ZSM-10 is also described in U.S. Pat. No. 3,692,470, which is incorporated herein by reference.

Various factors have an effect on the X-ray diffraction pattern of a zeolite. Such factors include temperature, pressure, crystal size, impurities, and type of cations present. For instance, as the crystal size of the type L zeolite becomes smaller, the X-ray diffraction pattern becomes broader and less precise. Thus, the term "zeolite L" includes any zeolites made up of cancrinite cages having an X-ray diffraction pattern substantially similar to the X-ray diffraction patterns shown in U.S. Pat. No. 3,216,789.

Type L zeolites are conventionally synthesized largely in the potassium form, i.e., in the theoretical formula given previously, most of the M cations are potassium. The M cations are exchangeable, so that a given type L zeolite, e.g., a type L zeolite in the potassium form, can be used to obtain type L zeolites containing other cations, by subjecting the type L zeolite to ion exchange treatment in an aqueous solution of appropriate salts. However, it is difficult to exchange all of the original cations, e.g., potassium, since some exchangeable cations in the zeolite are in sites which are difficult for the reagents to reach.

As previously mentioned, preferably the catalyst used in reaction zone 3 is nonacidic. Nonacidity can be achieved by use of alkaline metals or alkaline earth metals in the zeolite component, for example, as described in U.S. Pat. Nos. 4,104,320 and 4,435,311.

The term "nonacidic" is used in contrast to the acidic dual function catalysts such as platinum on halided alumina, or platinum rhenium on halided alumina, or platinum on an ammonium exchanged (and then calcined) zeolite. For examples of these dual function acidic reforming/dehydrocyclization catalysts, see U.S. Pat. No. 3,006,841; U.S. Pat. No. 3,415,737; and U.S. Pat. No. 3,783,123 (such as Example 16, pertaining to an ammonium exchanged zeolite support).

Although halides, particularly chloride, have been used in the past to achieve a measure of acidity in platinum alumina dual function reforming or dehydrocyclization catalysts, it should be noted that halides may be involved in the preparation of nonacidic highly selective dehydrocyclization catalysts, particularly when the support is an aluminosilicate such as zeolite L. Recent catalysts which involve use of halides in making nonacidic Group VIII metal-L zeolite catalysts are exemplified by U.S. Pat. No. 4,681,865; U.S. Pat. No. 5,073,652; U.S. Pat. No. 5,196,631; and U.S. Pat. No. 5,294,579. All of these latter cited patents exemplify nonacidic, monofunctional dehydrocyclization catalysts which have selectivity for converting paraffins to aromatics.

Referring again to the drawing, in reaction zone 3, the feed is contacted with the highly selective dehydrocyclization catalyst under dehydrocyclization reaction conditions to convert paraffins to aromatics. The term "highly selective dehydrocyclization catalyst" is used herein to refer to catalysts which, in the conversion of n-hexane to aromatics under dehydrocyclization reaction conditions as described hereinbelow, result in a selectivity for aromatics of at least 40% by weight, preferably at least 50%, more preferably at least 70%, and most preferably at least 80% selectivity for conversion of n-hexane to aromatics, on a per pass (excluding recycle conversion) basis.

Preferably the highly selective dehydrocyclization catalyst is used in the present invention under reaction conditions, such as those described hereinbelow, effective to achieve per pass conversion of paraffins to aromatics and other hydrocarbons of at least 50 wt. %, more preferably at least 60%, and most preferably at least 70%. The yield of desired aromatics product, on a per pass basis, is the per pass conversion times the selectivity.

Suitable reaction conditions include a temperature between 400° C. and 600° C., so that the highly selective dehydrocyclization reaction occurs with acceptable speed and selectivity.

Preferably, the dehydrocyclization is carried in the presence of hydrogen at a pressure adjusted so as to favor the reaction thermodynamically and limit undesirable hydrocracking reactions by kinetic means. The pressures used preferably vary from 1 atmosphere to 500 psig, more preferably 50 to 200 psig. The molar ratio of hydrogen to hydrocarbons preferably is from 1:1 to 10:1, more preferably 2:1 to 6:1.

The liquid hourly space velocity of the hydrocarbons through the catalyst bed in reaction zone 3 is preferably between 0.3 and 5, more preferably between 0.5 and 2.0.

As the dehydrocyclization reaction is endothermic, the combined fresh feed and recycle feed, and recycled hydrogen, are heated in one or more furnaces prior to introduction to the catalytic reaction zone. The furnaces are not shown as a separate feature in the simplified block flow diagram. Also the reaction zone shown in the simplified diagram is not split into a series of reforming or dehydrocyclization reactor vessels, although preferably the dehydrocyclization reaction is carried out in a series of reactor vessels. In addition, the simplified diagram does not show heat exchange steps.

Effluent from reaction zone 3 is passed to separation zone 5, which may comprise a series of separation steps. Hydrogen is recycled from separation zone 5 via line 6 back to reaction zone 3.

Product aromatics rich material is withdrawn via line 7 from separation zone 5 and is passed to separation zone 8. In separation zone 8, aromatics are separated and withd rawn as product via line 10. Nonaromatics are withdrawn via line 9. The separation of the aromatics from the nonaromatics in zone 8 may be done by extraction using a solvent, distillation, or by use of molecular sieves. In any of these separation means, for convenience, we use the term "raffinate" to refer to the paraffins rich stream separated from the aromatics product.

The term "rich in paraffins" is used to mean more than 50% by weight paraffins. Preferably, the raffinate contains more than 80 wt. % paraffins.

Use of molecular sieves for separating product aromatics from the paraffins rich raffinate can be done by passing the aromatics and paraffins through a bed of molecular sieves. The molecular sieves adsorb the normal paraffins and some of the isoparaffins present, but not the aromatics. To cause such a separation, the molecular sieve should have an effective pore diameter of from 4.5 to 5.5 Angstroms. Examples of such molecular sieves are silicalite, L zeolite, A zeolite, X zeolite, Y zeolite, offertite and ZSM-5 zeolite, with cations properly used to tailor the size of the zeolite opening to accommodate the desired separation.

Alternatively, the separation in zone 8 can be carried out by distillation to separate a "raffinate" stream which is rich in paraffins from the aromatic product.

Most preferably, the paraffins are separated from aromatics in zone 8 by solvent extraction, that is, the aromatics are absorbed into a solvent and thereby extracted from the reaction zone effluent aromatics-paraffins stream. The extracted aromatics can be separated from the solvent by distillation. Solvents that can be used in such a solvent extraction method include phenol, sulfolane and N-formyl morpholine. Preferred solvent extraction means useful for the present process, particularly including extractive distillation, are described further in U.S. Pat. No. 5,401,365, the disclosure of which is incorporated herein by reference.

After the aromatics removal step, dimethylbutanes remaining in the paraffins rich stream may range from 5 to 50 wt. %, preferably 10 to 40 wt. %, and more preferably 15 to 35 wt. %, and most preferably 20 to 30 wt. %, based on total weight of the raffinate stream (paraffins rich stream).

In accordance with this preferred embodiment of the present invention, prior to recycle of the paraffinic raffinate to reaction zone 3, dimethylbutanes are separated from the raffinate. Preferably, the dimethylbutanes are separated by distillation. I have found that the overall dehydrocyclization process is surprisingly efficient when dimethylbutanes are removed primarily downstream versus removing most of the dimethylbutanes upstream of the dehydrocyclization reaction zone. The dimethylbutanes are removed from separation zone 11 via line 12.

After dimethylbutanes removal from the above-described paraffins rich stream, the dimethylbutanes remaining preferably is from 0.01 to 15 wt. %, more preferably from 0.1 to 10%, and most preferably from 1 to 10 wt. % of the paraffins rich stream.

Preferably, the downstream dimethylbutanes removal of this embodiment is carried out to remove 70 to 99.8% of the dimethylbutanes from the paraffins rich stream, more preferably 75 to 99%, and most preferably from 80 to 95% of the dimethylbutanes, based on the total weight of the paraffins rich stream.

The drawing shows downstream dimethylbutanes removal after aromatics are separated from the recycle paraffins.

According to another preferred embodiment of the present invention, dimethylbutanes are removed downstream of the dehydrocyclization reaction zone but prior to treatment of the reaction zone effluent to separate aromatics from paraffins. Thus, according to this embodiment, a process is provided for dehydrocyclization of hydrocarbon which comprises:

(a) contacting fresh paraffins rich feed hydrocarbon containing 0.1 to 20.0 wt. % dimethylbutanes with a highly selective dehydrocyclization catalyst in a reaction zone under dehydrocyclization reaction conditions to convert paraffins to aromatics and obtain an aromatics rich effluent;

(b) removing dimethylbutanes from the aromatics rich effluent to obtain a paraffins-aromatics mixture of reduced dimethylbutane content;

(c) separating aromatics from the paraffins-aromatics mixture to obtain an aromatics lean raffinate; and (d) recycling the raffinate of to the reaction zone.

In this preferred embodiment, dimethylbutanes in the paraffins-aromatics mixture prior to downstream dimethylbutanes removal may range from 0.1% to 20% by weight, preferably 0.5% to 15%, more preferably 1% to 12%, and most preferably 2% to 10%, based on the weight of the mixture.

Remaining dimethylbutanes in the paraffins-aromatics mixture after dimethylbutane separation may range from 0.01% to 8%, preferably from 0.05% to 6%, more preferably from 0.1% to 4%, and most preferably from 0.2% to 1%, based on the weight of the mixture.

Preferably, the downstream dimethylbutane removal is carried out by distillation. The distillation step may be carried out in one or more distillation columns, using conventional distillation techniques conducted in accordance with the dimethylbutanes removal requirements of the present invention. In the embodiment where downstream dimethylbutane removal is carried out prior to aromatics separation, the preferred distillation separation step removes 60–99.5% of the dimethylbutanes from the aromatics rich effluent, more preferably 70–99%, most preferably 80–90% of the dimethylbutanes in the aromatics rich effluent. It may be noted that the removal referred to in this paragraph is based on feed to the dimethylbutanes downstream removal step, not on the fresh feed. Percent removal based on fresh feed is the basis of the next two paragraphs.

In the present invention, for any of the embodiments, dimethylbutanes are removed primarily downstream of the highly selective dehydrocyclization step. The term "primarily" is used to mean at least 50% based on the total dimethylbutanes in the fresh feed, exclusive of that portion of the dimethylbutanes that are effectively removed from the system due to cracking or other dimethylbutane conversion reactions in the dehydrocyclization reaction step. Usual amounts of dimethylbutanes removal by conversion in the dehydrocyclization reaction zone is 10% to 50%, more typically 15% to 45% based on dimethylbutanes content in the fresh feed.

Preferably, at least 50% of the dimethylbutanes that are removed by distillation or other physical separation (as opposed to removal by reactive conversion to other materials in the reaction zone) are removed by downstream removal, more preferably at least 60% of the dimethylbutanes are removed from the feed to the dehydrocyclization step by downstream removal. This relatively high percent removal is in contrast to that portion of dimethylbutanes which may be removed upstream, for example, from the fresh feed when the fresh feed, alone or with recycle paraffins, is prefractionated to remove $C_5$- and other hydrocarbons. Downstream removal refers to downstream of the reaction zone. Percent removal of dimethylbutanes, unless otherwise indicated, is based on the dimethylbutanes in the fresh feed.

To achieve relatively high percentage dimethylbutanes removal downstream of the reaction zone, as is required by the present invention, the percent removal of dimethylbutanes from the feed to the downstream dimethylbutane removal process must be high. Thus, as previously indicated, preferably the percent dimethylbutanes removal based on the paraffins in the feed to the downstream dimethylbutanes removal step is at least 70%, and more preferably at least 80%.

Referring again to the drawing, prior to the dehydrocyclization step, the fresh feed, or the combined fresh feed and recycle paraffins, such as the raffinate shown by line 13, can be distilled to remove $C_5$- hydrocarbons. The $C_5$- is not suitable feed for the dehydrocyclization reaction step. The prefractionation step, which is a preferred step to remove $C_5$-, is not shown in the drawing. The prefractionation of the fresh feed or the combined fresh feed and recycle raffinate stream can remove dimethylbutanes along with removal of $C_5$- and other hydrocarbons. However, according to the present invention, as previously indicated, the amount of dimethylbutanes removed by such upstream prefractionation or distillation is less than 50% of the total dimethylbutanes, based on the fresh feed, preferably less than 40% of the dimethylbutanes removed by distillation or other physical separation.

EXAMPLES

The first configuration of this example is one where raffinate, from an aromatics extraction unit following a highly selective dehydrocyclization reforming reaction step, is combined with fresh feed, and then distilled to remove $C_5$- and a minor portion of the dimethylbutanes. Then the distilled fresh feed and raffinate is fed to the dehydrocyclization step. This is referred to as the base case.

In a second case, in accord with the invention, raffinate from the aromatics extraction unit is distilled to remove a major portion of the dimethylbutanes, and then the distilled raffinate, along with fresh feed, are combined and passed to the dehydrocyclization step.

In both cases, the fresh feed is composed of the following components: $C_5$-, dimethylbutanes (DMBs), 2-methylpentanes, 3-methylpentanes, methylcyclopentane, n-hexane, cyclohexane. In this example, the dimethylbutanes portion of the feed contained 18% 2,2-dimethylbutane and 82% 2,3-dimethylbutane. The relative feed compositions for the two cases are shown below, on a liquid volume percent basis. (Weight percent for these type feeds would be close to liquid volume percent.)

| Feed Component | Base Case | Invention |
|---|---|---|
| $C_5$– | 0.1 | 0.1 |
| dimethylbutanes | 21.5 | 7.3 |
| 2-methylpentane | 76.4 | 67.8 |
| 3-methylpentane | 61.0 | 62.0 |
| methylcyclopentane | 40.2 | 43.7 |
| n-hexane | 100.0 | 100.0 |
| cyclohexane | 9.8 | 10.3 |

The per pass conversion in the highly selective dehydrocyclization step in this example is shown below, as a percent by weight of each feed component. The catalyst used was nonacidic PtL zeolite.

| | |
|---|---|
| dimethylbutanes | 29.8 |
| 2-methylpentane | 80.8 |
| 3-methylpentanes | 84.9 |
| methylcyclopentane | 90.5 |
| n-hexane | 95.0 |
| cyclohexane | 98.6 |

The benzene yield for the two processes are shown below in pounds of benzene per pound of feed to the reaction zone:

| Base Case | Invention |
|---|---|
| 0.65 | 0.68 |

The yield of benzene in the invention case was 3% greater on a feed basis compared to the base case. This is a substantial economic advantage for the preferred case, because the feedstock cost is a major portion of the total cost of making product aromatics. Distillation costs were also surprisingly advantageous for the invention case versus the base case.

What is claimed is:

1. A process for dehydrocyclization of hydrocarbon which comprises:

(a) contacting a naphtha feedstream containing 0.1 to 20.0 wt. % dimethylbutanes with a highly selective dehydrocyclization catalyst in a reaction zone under dehydrocyclization reaction conditions to convert paraffins to aromatics and obtain an aromatics rich effluent;

(b) separating aromatics from the effluent to obtain an aromatics lean raffinate;

(c) removing dimethylbutanes from the aromatics lean raffinate to obtain a raffinate of reduced dimethylbutane content; and (d) recycling the raffinate of reduced dimethylbutane content to the reaction zone.

2. A process in accordance with claim 1 wherein the highly selective dehydrocyclization catalyst is a nonacidic catalyst.

3. A process in accordance with claim 2 wherein the catalyst comprises a Group VIII metal on a unidimensional crystalline aluminosilicate.

4. A process in accordance with claim 3 wherein the aluminosilicate is zeolite L, zeolite omega or mordenite.

5. A process in accordance with claim 4 wherein the aluminosilicate is zeolite L and the Group VIII metal is platinum.

6. A process in accordance with claim 1 wherein the aromatics are separate from the raffinate by solvent extraction, distillation, or molecular sieve extraction.

7. A process in accordance with claim 6 wherein the aromatics are separated from the raffinate by solvent extraction.

8. A process for dehydrocyclization of hydrocarbon which comprises:

(a) contacting a naphtha feedstream containing 0.1 to 20.0 wt. % dimethylbutanes with a highly selective dehydrocyclization catalyst in a reaction zone under dehydrocyclization reaction conditions to convert paraffins to aromatics and obtain an aromatics rich effluent;

(b) removing dimethylbutanes from the aromatics rich effluent to obtain a paraffins-aromatics mixture having a reduced dimethylbutane content;

(c) separating aromatics from the paraffins-aromatics mixture to obtain an aromatics lean raffinate; and (d) recycling the raffinate to the reaction zone.

9. A process in accordance with claim 8 wherein the highly selective dehydrocyclization catalyst is a nonacidic catalyst.

10. A process in accordance with claim 9 wherein the catalyst comprises a Group VIII metal on zeolite L.

* * * * *